US005482407A

United States Patent [19]

Raaf

[11] Patent Number: 5,482,407

[45] Date of Patent: Jan. 9, 1996

[54] HELICAL OUTRIGGER ASSEMBLY SERVING AS AN ANCHOR FOR AN UNDERPINNING DRIVE ASSEMBLY

[75] Inventor: David B. Raaf, Independence, Mo.

[73] Assignee: Atlas Systems Inc., Independence, Mo.

[21] Appl. No.: 187,181

[22] Filed: Jan. 25, 1994

[51] Int. Cl.[6] ..... E02D 5/00

[52] U.S. Cl. ..... 405/230; 405/229

[58] Field of Search ..... 405/230, 229, 405/232, 244; 52/170, 298

[56] References Cited

U.S. PATENT DOCUMENTS

| | | | |
|---|---|---|---|
| 3,148,739 | 9/1964 | Mattingly et al. . | |
| 3,846,991 | 11/1974 | Wisotsky . | |
| 4,634,316 | 1/1987 | Cernak et al. | 405/232 X |
| 4,634,319 | 1/1987 | May . | |
| 4,702,047 | 10/1987 | Stokes . | |
| 4,778,142 | 10/1988 | Roba . | |
| 4,800,700 | 1/1989 | May . | |
| 4,854,782 | 8/1989 | May . | |
| 5,011,336 | 4/1991 | Hamilton et al. . | |
| 5,120,163 | 6/1992 | Holdeman et al. . | |
| 5,139,368 | 8/1992 | Hamilton et al. . | |
| 5,171,107 | 12/1992 | Hamilton et al. . | |
| 5,213,448 | 5/1993 | Seider et al. . | |
| 5,234,290 | 8/1993 | Collins . | |

FOREIGN PATENT DOCUMENTS

| | | | |
|---|---|---|---|
| 8901192 | 12/1990 | Netherlands | 405/230 |

*Primary Examiner*—Dennis L. Taylor
*Attorney, Agent, or Firm*—Kokjer, Kircher, Bowman & Johnson

[57] ABSTRACT

A helical outrigger apparatus attached to an underpinning drive assembly for exerting an auxiliary anchoring force upon the underpinning drive assembly while sinking piers, pilings, screw-type underpinnings and the like. The piers, pilings, etc. are used to lift and support new and existing structures. The anchoring force is used to supplement a principal anchoring force provided by a dead weight of the structure. The helical outrigger apparatus fastens to a pier bracket which supports the underpinning drive assembly during operation. The helical outrigger apparatus includes a screw-type helical anchor that is sunk into the ground temporarily. The apparatus includes at least one outrigger fastened to the pier bracket. Multiple helical outriggers with anchors may be located evenly along the drive assembly. Each outrigger assembly includes an arm that is pivotally and telescopically moveable to facilitate connection between the pier bracket and the corresponding helical anchor.

22 Claims, 3 Drawing Sheets

HELICAL OUTRIGGER ASSEMBLY SERVING AS AN ANCHOR FOR AN UNDERPINNING DRIVE ASSEMBLY

FIELD OF THE INVENTION

The present invention is generally related to a system for sinking underpinnings to support existing structures. More specifically, the invention relates to an outrigger assembly with helical anchors which provide resistance against upward movement of an underpinning drive assembly while the drive assembly sinks piers, pilings, screw-type underpinnings and the like.

BACKGROUND OF THE INVENTION

Quite often structures, such as building, patios and the like, are constructed on earth having a composition and density that is unable to bear the weight of the structure without settling. The foundations for these structures inevitably settle unevenly which causes the structure to lean and/or the foundation to crack. This type of settlement, if left unattended, creates an endless realm of problems.

In the past, conventional systems have been proposed for lifting the structure to, and supporting the structure at or near, its original unsettled position for the remainder of its useful life. For instance, U.S. Pat. Nos. 4,854,782 and 4,634,319 disclose apparatuses which drive individual piers or pilings vertically downward along side the structure until the piers or piles reach bedrock or a load bearing strata region, at which the piers experience a desired amount of resistance. Once the piers are driven to a desired depth, the foundation of the structure is raised by a desired amount and fastened to the piers with a bracket assembly. The piers and bracket assemblies are coupled to one another in order to support the building for an indefinite period of time. Hereafter, the piers, pilings, screw-type underpinnings, and the like are collectively referred to by any of these terms and simply as "underpinnings."

An alternative apparatus has been proposed (U.S. Pat. No. 4,800,700) for lifting and supporting concrete slabs, concrete floors and the like, that have settled and need to be righted or leveled to cure and prevent cracks and other structural defects. The apparatus of the '700 patent supports the slab by (1) cutting a plurality of access holes in the slab, (2) inserting a lift plate through each access hole, (3) rotating and drawing each lift plate against the underside of the slab, and (4) driving underpinning piers through the access holes to bedrock or a desired load bearing strata. After the necessary number of piers are driven, hydraulic rams are attached to the lifting plates and used to raise the slab to a desired level. Subsequently, the lifting plates are permanently secured to the piers and function as an underpinning support for the slab. The U.S. Pat. Nos. 4,800,700; 4,854,782; and 4,634,319 are incorporated herein by reference.

However, when using a hydraulic ram to drive pilings into the ground, the ram exerts a substantial upward force. Thus, it is necessary to exert an equal and opposite downward force upon the hydraulic rams to drive the pilings into the ground. Heretofore, this equal and opposite force was obtained by fastening the hydraulic rams to the side of the foundation, or the underside of the slab, and relying upon the structure's dead weight and any weights that could be hung on the drive assembly.

Often it is desirable to drive the piers to bedrock or a load bearing strata which exerts a force upon the piers that exceeds the weight of the structure. Also, in order to reach bedrock or a desired load bearing strata, it is often necessary to drive piers through an intermediate layer of material which is extremely dense or compacted. For instance, fill material may be dumped on an inclined surface and compacted to provide a level surface for supporting a foundation, only to settle after the building is erected. Also, the intermediate layer may simply represent a clay region or the like. In either situation, the compacted fill or clay region will be denser than the underlying soils. Accordingly, the underpinning drive assembly will experience greater resistance when the pier is forced through the fill material or clay, as compared to a lesser resistance experienced when driving the pier through the uncompressed underlying soils. Heretofore, when such dense regions were encountered, the hydraulic ram simply raised the foundation without driving the pier through the fill or clay region.

To compensate for this problem when underpinning a concrete slab, such as a patio, the systems of the '319 and '700 patents provide L-shaped wings on opposite sides of the bracket assembly to hold metal plates which added weight to the dead weight of the structure. However, during operation, it was necessary to separately add and remove these weights. Also, the systems of the '319 and '700 patents are intended for use with concrete slabs which do not support a structure. Thus, the concrete slab did not offer a large amount of dead weight, as compared to a building. Also, slight increases, through the addition of stationary weights, were sufficient to reach a load bearing strata sufficient to support a concrete slabs.

A variety of alternative methods have been proposed for supporting existing structures, such as in U.S. Pat. Nos. 5,213,448; 5,171,107; 5,139,368; 5,120,163 and 5,011,336. Each of these underpinning methods utilized screw-type underpinnings, in place of piers, which were driven to a desired depth. An underpinning bracket assembly was coupled between the screw-type underpinning and the foundation and the screw-type underpinning was used to support the foundation in place of the piers. However, these alternative methods relied on the dead weight of the drilling unit to force the screw-type underpinning downward. Thus, the screw-type underpinning was also unable to penetrate overly hard layers.

The need remains in the industry for improved designs and implementation techniques to address the problems and drawbacks heretofore experienced. The primary objective of this invention is to meet this need.

SUMMARY OF THE INVENTION

An object of the present invention is to provide a helical outrigger assembly fastenable to, and serving as an auxiliary anchoring force for an underpinning driving/sinking assembly while sinking the piers, pilings, screw-type underpinnings and the like into the ground.

Another object of the present invention is to provide an outrigger assembly that is easily secured to a bracket assembly which is connected to the driving assembly and which couples the foundation to the underpinning.

Another object of the present invention is to provide a collar, including a telescopic arm, within the outrigger assembly for easily connecting a helical anchor to a pier bracket of the driving assembly.

Another object of the present invention is to provide an outrigger assembly for connecting the drive stand to the helical shaft which is rotatably and axially movable relative to the drive stand, in order to locate an eye upon a telescoping arm about a threaded rod connected to the helical anchor.

Other and further objects of the invention, together with the features of novelty appurtenant thereto, will appear in the detailed description set forth below.

In summary, the invention includes a helical outrigger apparatus attached to an underpinning drive assembly for exerting an auxiliary anchoring force upon the underpinning drive assembly while sinking piers, pilings, screw-type underpinnings and the like. The piers, pilings, etc. are used to lift and support new and existing structures. The anchoring force is used to supplement a principal anchoring force provided by a dead weight of the structure. The helical outrigger apparatus fastens to a pier bracket which supports the underpinning drive assembly during operation. The helical outrigger apparatus includes a screw-type helical anchor that is sunk into the ground temporarily. The apparatus includes at least one outrigger fastened to the pier bracket. Multiple helical outriggers with anchors may be located evenly along the drive assembly. Each outrigger assembly includes an arm that is pivotally and telescopically moveable to facilitate connection between the pier bracket and the corresponding helical anchor.

BRIEF DESCRIPTION OF THE DRAWING

The objects and features of the invention noted above are explained in more detail with reference to the drawings, in which like reference numerals denote like elements, and in which.

DETAILED DESCRIPTION OF THE INVENTION

Figure 2:
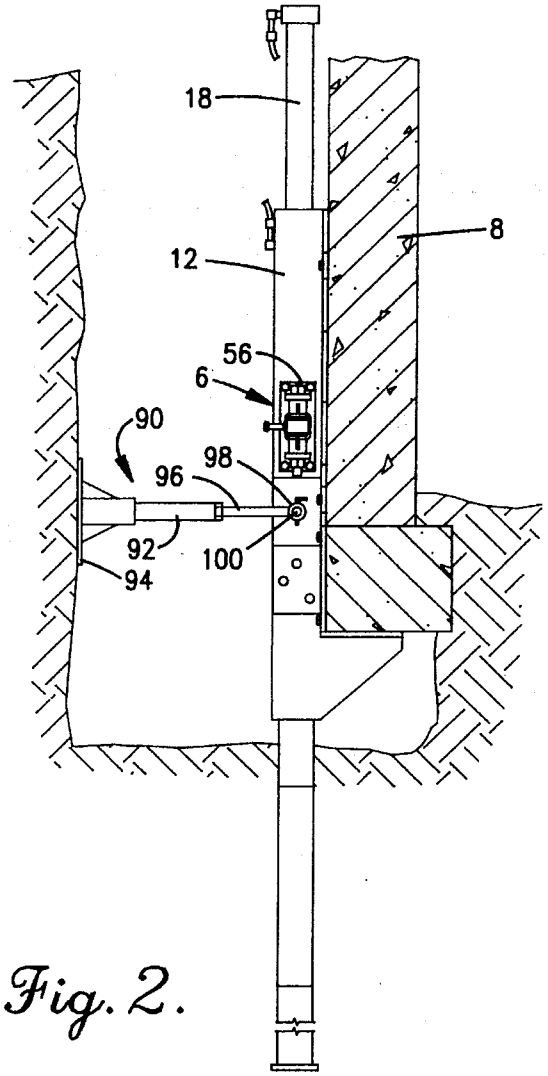
FIG. 2 is a side planar view of an underpinning drive assembly connected to helical outriggers according to a first embodiment of the present invention.
Figure 1:
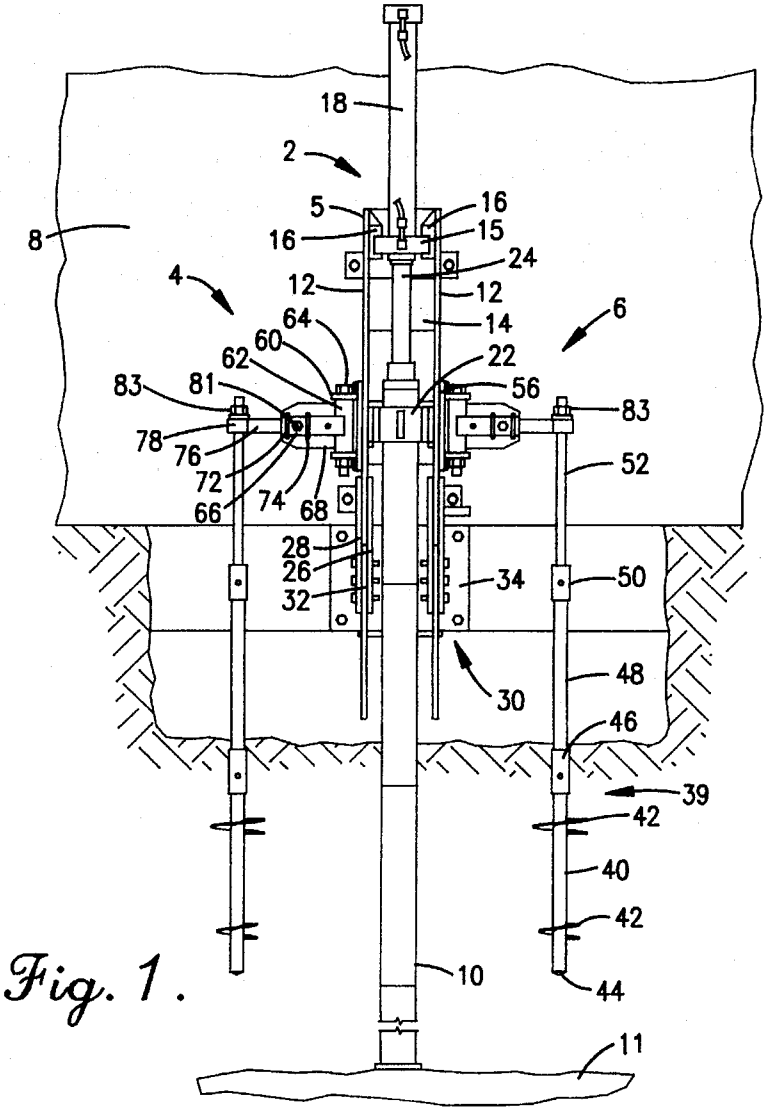
FIG. 1 is a front planar view of an underpinning drive assembly connected to helical outriggers according to a first embodiment of the present invention.
Figure 4:
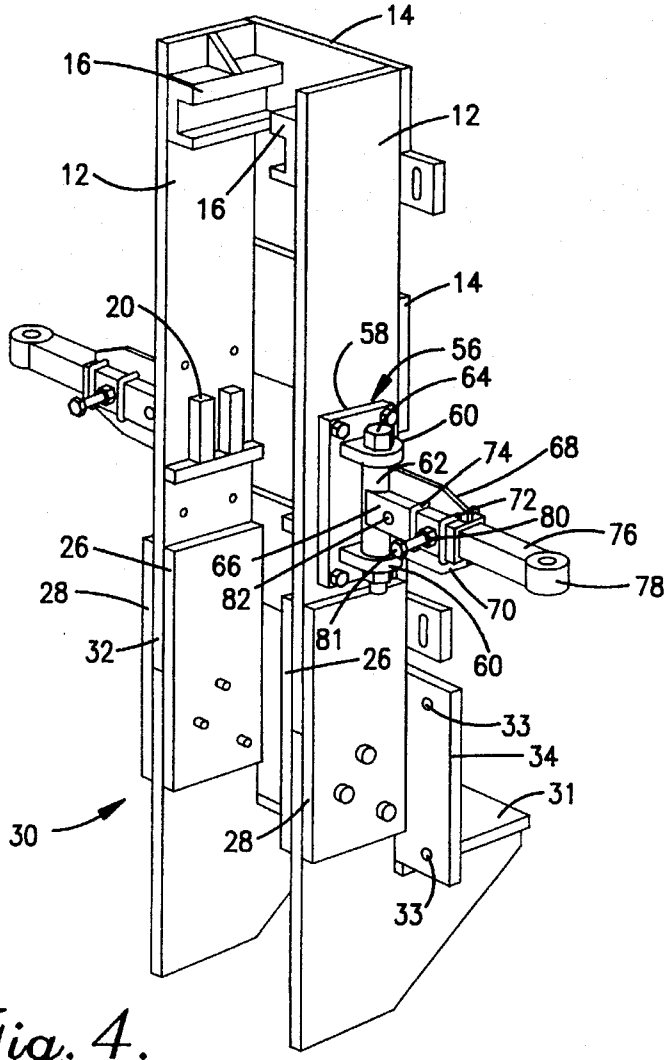
FIG. 4 is an elevational view of a pier bracket attached to helical outriggers according to a first embodiment of the present invention.

FIG. 1 generally illustrates a preferred embodiment of the present invention in which an underpinning drive assembly 2 is attached through a pier bracket 5 to a foundation 8 of an existing structure. The pier bracket 5 is attached on opposite sides to helical outriggers 4 and 6 which function as an anchor while the underpinning drive assembly 2 sinks each pier, piling, screw-type underpinning or the like. In the preferred embodiment, the helical outriggers 4 and 6 function to supplement a dead weight of an existing structure while sinking a pier 10 to load bearing strata 11.

As illustrated in FIGS. 1–6, the underpinning drive assembly 2 and pier bracket 5 of the preferred embodiments substantially resemble those disclosed in U.S. Pat. Nos. 4,634,319 and 4,800,700, both of which were incorporated by reference. Accordingly, the underpinning drive assembly 2 and pier bracket 5 are not discussed hereafter in detail. Briefly, the pier bracket 5 (FIG. 4) includes vertical side plates 12 extending parallel to one another and positioned along the side of the foundation 8. The side plates 12 are fastened to one another with cross supports 14. The vertical side plates 12 include holding brackets 16 on an inner surface thereof for securing a drive cylinder 18 (FIGS. 1 and 2) to the side plates 12 in an upright position. The drive cylinder 18 includes a hydraulic ram 24 which slides in the vertical direction to drive the piers 10 downward. By way of example only, the pier bracket 5 is formed of ⅝-inch thick cut steel plate welded assembly conforming to ASTM A-36, A-568 and A-569 standards.

The drive cylinder 18 also includes a base 15 that is slidably received within the holding brackets 16. By way of example only, the drive cylinder 18 may be a hydraulically driven actuator capable of pressing 42-inch steel pier sections through soil to a capacity of 65,000 lbs. resistance. The vertical side plates 12 also include lower holding brackets 20 (FIG. 4) which receive a sleeve 22 (FIG. 1) that surrounds the pier 10. The sleeve 22 maintains the pier 10 in a desired horizontal position as the hydraulic ram 24 sinks the piers 10. As one example, the piers 10 may constitute 42-inch, 3½-inch O.D. mill-rolled galvanized steel sections with a 0.160-inch gauge wall with a yield strength of 50,000 psi. The pier 10 may include a triple coat corrosion protection of zinx, chromate, and clear polymer coating. The initial pier 10 section includes a 4-inch O.D. collar on its lower end to assist in reducing wall friction during driving the pier to capacity.

Near the lower end of the pier bracket 5, the vertical side plates 12 include inner and outer plates 26 and 28 (FIG. 4) fastened thereto. The inner and outer plates 26 and 28 are secured to opposite sided of the vertical side plates 12 and project beyond the lower ends of the side plates 12 to form slots therebetween. The inner plates 26 include holes therethrough which align with corresponding holes in the outer plates 28. The slots between the inner and outer plates 26 and 28 receive an L-shaped shoe 30, and are secured thereto via the holes. The L-shaped shoe 30 fastens to the foundation 8.

The L-shaped shoe 30 includes a bottom portion 31 which extends under and supports the base of the foundation 8. The shoe 30 further includes holes 33 therethrough to allow a face 34 of the shoe 30 to be bolted to the side of the foundation 8. By way of example only, the face 34 may be bolted to the foundation 8 through steel concrete anchors constituting 5½-inch long by ½-inch O.D. steel concrete anchor bolts with a pull out capacity of 6,310 pounds. The show includes a set of wings 32 which are oriented in a vertical direction and extend outward from the face 34 and are slidably received between the inner and outer plates 26 and 28. Holes in the wings 32 and the inner and outer plates 26 and 28 correspond with one another in order that the shoe 30 may be fastened to the underpinning drive assembly 2.

The helical outriggers 4 and 6 are identical, and thus only one will be described hereafter. The helical outrigger 6 includes a helical anchor 39 (FIG. 1) having at least one helix 42 on a drive shaft 40 which pulls the drive shaft 40 into the ground as the helix 42 rotates. The helix 42 is located near the tip 44 of the drive shaft 40. By way of example only, the drive shaft 40 may be a standard 1¼-inch square hot rolled steel starter section with a minimum yield strength of 55,000 psi and a minimum tensile strength of 90,000 psi. The starter section is 3½ feet in length and has two grade 50 hot rolled helix plates welded thereon. The helix size may be, for instance 6-inch or 8-inch, but may vary depending upon the application. Couplers 46 are formed to securely receive an upper end of the drive shaft 40 and a lower end of an extension shaft 48. Multiple extension shafts 48 and couplers 46 may be used to allow the drive shaft 40 and helix 42 to be sunken to a desired depth in order to obtain a desired anchoring force. By way of example only, the couplers 46 may be 6-inch long steel couplings with 3.125 inch O.D. and 0.180 inch wall thickness welded inside bottom on each connected pipe section with 3 inches exposed. The extension shafts 48 may be 1¼-inch square size and 3½ feet in length. The extension shafts 48 may be formed of hot rolled steel with a minimum yield strength of 55,000 psi and a minimum tensile strength of 90,000 psi. Each extension shaft 48 includes head that has a welded collar with pin hole therethrough.

Optionally, the extension shafts 48 may also include one or more helixes 42. The final extension shaft 48 extending above ground level includes a transition coupler 50, that substantially resembles the couplers 46, which connects the final extension shaft 48 to a threaded transition rod 52. The transition rods may be continuous thread steel rods of ⅝-inch diameter and of 18-inches in length. The upper end of the transition rod 52 is secured to outrigger body 54.

The outrigger body 54 includes a base 56 having a rectangular flat plate 58 which abuts against the outer side of the vertical side plates 12. The base 56 further includes supports 60 which project laterally outward from the flat plate 58. The supports 60 represent half moon shaped flanges with a hole in the center thereof. The supports 60 are spaced apart from one another to receive a tubular pivot joint 62 oriented such that a longitudinal axis of the pivot joint 62 extends vertically between the supports 60. The pivot joint 62 and the supports 60 receive a bolt and nut assembly 64 therethrough, such that the pivot joint 62 rotates along an arcuate path (see A, in FIG. 3) in a horizontal plane about the longitudinal axis of the bolt and nut assembly 64.

The pivot joint 62 is formed integral with, such as through welding or molding, a square collar arm 66 and bracing flanges 68 and 70. The square collar arm 66 extends outward from, and in a direction substantially perpendicular to the pivot joint 62. The bracing flanges 68 and 70 extend in a direction parallel to and along top and bottom sides of, the square collar arm 66. The bracing flanges 68 and 70 are formed integral (e.g., welded) with, and function to provide vertical support for, the square collar arm 66. Bracing ribs 72 and 74 are located approximate an outer end of the square collar arm 66 and bracing flanges 68 and 70 to provide additional support for the square collar arm 66. The bracing ribs 72 and 74 surround the square collar arm 66 and are secured, such as through welding with the bracing flanges 68 and 70.

The square collar arm 66 is formed with a hollow recess therein having a square cross-section. This hollow square recess slidably receives a telescoping arm 76 also having a square cross-section. The telescoping arm 76 includes an inner end which extends into the square collar arm 66 and an outer end which includes a circular eye 78 formed integral therewith. A keeper 80 is formed on the square collar arm 66 and may include a threaded opening through the square collar arm which receives a bolt 81 that is tightened against a side of the telescoping arm 76 to hold the arm in a desired position. The rectangular cross section of the telescoping arm 76 which is received closely within the square hollow recess of the square collar arm 66 prevents the eye 78 from rotating about the longitudinal axis of the telescoping arm 76. The eye 78 includes a hole through the center thereof which receives the upper end of the transition rod 52. A nut and washer 83 are threaded upon the transition rod 52 to secure the helical anchor 38 to the telescoping arm 76 and consequently to the underpinning drive assembly 2.

The square collar arm 66 also includes a shipping key hole 82 located at the end proximate the radial pivot point near the pivot joint 62. When not in operation, the telescoping arm 76 is slid inward into the square collar arm 66 until a hole extending through the telescoping arm approximate its inner end aligns with the shipping key hole 82 in the square collar arm 66. Thereafter, a pin is inserted through the shipping key hole 82 to secure the telescoping arm 76 at a retracted position within the outrigger body 54.

Figure 3:
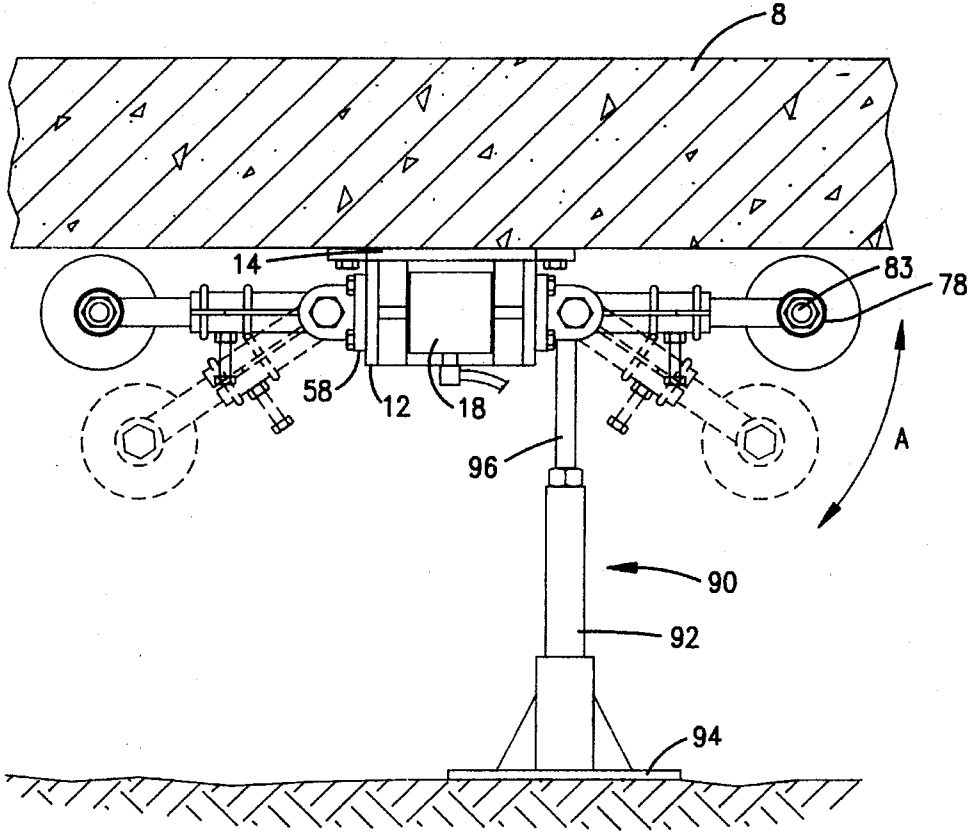
FIG. 3 is a top planar view of an underpinning drive assembly connected to helical outriggers according to a first embodiment of the present invention.

Referring to FIG. 3, a reaction brace 90 is positioned proximate the pier bracket for providing lateral/horizontal support for the underpinning drive assembly 2. The reaction brace 90 includes a steel cylinder 92 with a base grip plate 94 for abutting against an earth wall within an excavated region surrounding the underpinning drive assembly 2. A threaded steel bar 96 includes one end that is threadably received within the cylinder 92 and an opposite end that is includes a screw head 98 (FIG. 2) having a top receptacle hole formed therein. The top receptacle hole receives a locking bar 100. The locking bar 100 is releasable fastened to the pier bracket and includes small holes extending laterally through opposite ends thereof. These small holes receive cotter pins, thereby fastening the steel bar 96 to the pier bracket 5.

Turning now to the operation of the first embodiment, initially, an area of earth is excavated immediately adjacent an existing structure's foundation 8 to expose the footer of the foundation 8. This excavation area may be 4 feet in width and extend approximately 1 foot beneath the base of the footer. A chipping hammer is used to prepare the footer for mounting the pier bracket 5 thereto. The vertical and bottom faces of the footer should be free of all dirt, debris and loose concrete, to provide firm bearing surfaces for the pier bracket. The pier bracket 5 is mounted on the underpinning drive assembly 2 and then lowered into the excavation area adjacent the foundation. The pier bracket 5 is then seated against the footer and fastened to the foundation 8 through steel concrete anchors.

The vertical and bottom faces of the footer should be smooth and formed at right angles to each other, in order that the face 34 and bottom portion 31 of the shoe 30 of the pier bracket 5 will confront continuous bearing surfaces on the vertical or horizontal planes. However, if the bottom and vertical faces of the foundation 8 are not smooth, then pressure bearing grout (not shown) is injected into the gaps between the face 34 and the vertical face of the foundation, and between the bottom portion 31 and the bottom surface of the foundation. This grout provides proper load bearing support prior to the lifting operation.

Thereafter, a rotary torque motor apparatus is used to install each helical anchor 38. The helical anchors 38 are aligned in a direction substantially parallel to the side of the building, such that when the anchors 38 are drilled into the ground, they extend substantially straight down. Further, the helical anchors 38 are positioned anywhere along opposite sides of the underpinning drive assembly 2 so long as the transition rod 52 is within the range of the eye 78. The helical outriggers 4 and 6 provide over 180° of arcuate movement for the eye 78. This movement is limited only by the foundation 8 and the point at which the square collar arm 66 abuts against the base 56. For instance, the drive shafts 40 may be set approximately 18-inches away from the pivot joint 62 of the pier bracket 5 on either side thereof.

The installation depth is determined by the required installation torque so as to provide the minimum pullout capacity for each helical anchor 38. As each drive shaft 40 is drilled downward, couplers 46 and extension shafts 40 are added to each helical anchor 38. These extension shafts and couplers 48 and 46 are continuously added until the helical anchors 38 are sunk to a desired depth to provide the correct amount of resistance. Next, the transition couplers 50 are secured to the upper end of the extension shaft 48 projecting from the ground. Each collar arm 66 is swung about the pivot joint 62 and the telescoping arm 76 is slid radially outward to position the eye 78 over the center of the longitudinal axis of the helical anchor 38. The threaded transition rod 52 is inserted downward through a corresponding eye 78 and the telescoping arm 76 is moved radially and arcuately to align a lower end of the transition rod 52 with the transition coupler 50. Next, the transition rod 52 is secured within the transition coupler 50 and the nut and washer assembly 83 on the upper end of the transition rod 52 is tightened against the eye 78. Also, the keeper 80 is screwed inward to secure the telescoping arm 76 at a desired position.

The reaction brace 90 is inserted such that the base grip plate 94 is mounted against the front face of the earth sidewall. The threaded steel bar 96 is rotated until the receptacle hole in the screw head 98 aligns with the corresponding hole in the pier bracket 5. The locking bar 100 secures the reaction brace 90 to the pier bracket 5.

Once the helical anchors 38 are secured to the underpinning drive assembly 2, the piers 10 are sunk in the conventional manner. Briefly, the piers 10 are continuously hydraulically driven with the drive cylinder 18. The initial pier 10 includes friction collar on its bottom end. Additional 42-inch sections of the pier may be added as necessary, until bedrock or an equal load bearing strata is reached. For instance, when the pier 10 experiences a 65,000 lbs. load. If necessary, the last pier may need to be cut to a desired length. Thereafter, the drive cylinder 18 and the helical outrigger assembly 4 and 6 are removed from the pier bracket 5. To remove the helical anchors 38, the torque motor 10 rotates the helical anchors 38 in an opposite direction. In this manner, the helical anchors and outrigger assembly 4, 6 and 38 are reusable. Finally, the foundation is raised to the desired level in a conventional manner.

While the first embodiment is illustrated as used with an underpinning drive assembly 2 which is fastened to the outside of a foundation through a pier bracket 5, the present invention is not limited to such a device. Instead, any number of helical outriggers may be used. For instance, two outriggers may be installed on each side of the pier bracket, with one above the other. Alternatively, only one outrigger may used. Further, the helical outrigger assembly 4, 6 may be used with a variety of known pier brackets and underpinning driving assemblies which are used when sinking piers, pilings, screw-type underpinnings and the like. For instance, the present helical outrigger assembly may be used in conjunction with the pier bracket and underpinning drive assembly disclosed in U.S. Pat. No. 4,800,700, for lifting and supporting concrete slabs.

Figure 5:
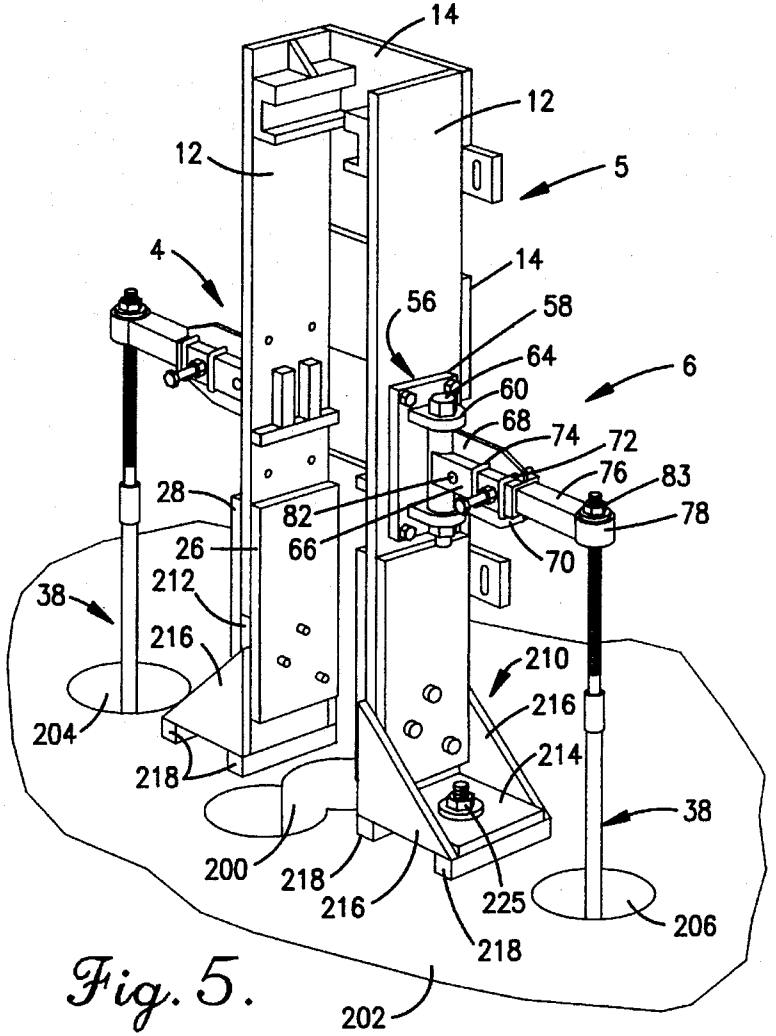
FIG. 5 is an elevational view of an underpinning drive assembly connected to helical outriggers according to a second embodiment of the present invention.

FIG. 5 illustrates an alternative embodiment, in which the invention is implemented with a pier bracket 5 used to lift concrete slabs 202. The pier bracket 5 of FIG. 5 substitutes footings 210 for the shoe 30. Each footing 210 includes a support plate 212 that extends upward between, and is secured to, the inner and outer plates 26 and 28. A horizontal plate 214, within each footing, includes one end that abuts against, and is secured to, the vertical plate 212. Braces 216 also secure the horizontal plate 214 to the support plate 212. Base pegs 218 are secured to the bottom surface of the horizontal plate 214 and support the pier bracket 5. A bolt and nut assembly 225 extend through the horizontal plates 214 and are secured to a lift plate (not shown) under the concrete slab. The lift plate is inserted through the access hole 200 and used as disclosed in the '700 patent.

The helical outrigger assemblies 4 and 6 are still connected to opposite sides of the pier bracket 5. However, the pier bracket 5 is mounted above, and operated through, an access hole 200 drilled in the floor of the concrete slab 202. As illustrated in FIG. 5, similar access holes 204 and 206 are drilled, through the concrete slab, on opposite sides of the pier bracket 5 to allow the helical anchors 38 to be sunk under the concrete slab 202. In this alternative embodiment, the operation of the present invention substantially resembles that above, however prior to sinking the helical anchors 38 into the ground, the access holes 204 and 206 must be drilled.

Similarly, the present helical outrigger assembly may be used with a variety of bracket assemblies which fasten foundations to piers, pilings and screw anchors. For instant, the present outrigger assembly may be fastened to the bracket assemblies disclosed in U.S. Pat. Nos. 4,854,782; 5,139,368; 5,011,336; 5,120,163; 5,171,107; and 5,213,448. The present outrigger assembly may be fastened to, and serve as a temporary anchor for, the rotary tool used to sink the screw-type underpinnings disclosed in the above-noted patents.

Figure 6:
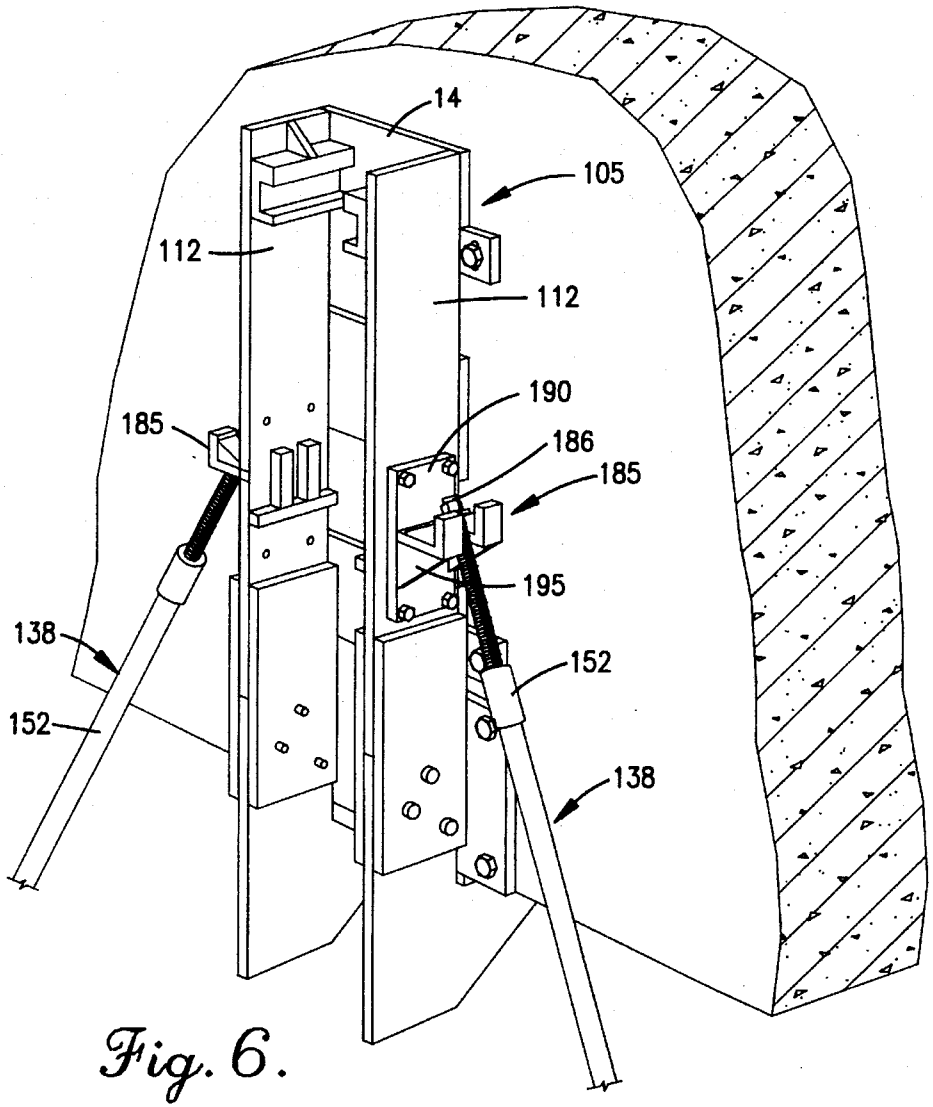
FIG. 6 is an elevational view of an underpinning drive assembly connected to helical outriggers according to a third embodiment of the present invention.

FIG. 6 illustrates an alternative embodiment for the helical outrigger assembly. In the embodiment of FIG. 6, the helical anchors 138 are directly attached to the vertical side plates 112 of the pier bracket 105. More specifically, the helical anchors 138 include upper ends which are secured to the transition rods 152 via transition couplers (not shown). The upper ends of the transition rods 150 are received within hook members 185 located on opposite sides of the vertical side plates 112. In this alternative embodiment, the nuts and washers 186 are threaded upon the upper end of the transition rod 150 and screwed into the hook members 185 to securely fasten the pier bracket 105 to the helical anchors 138. The washers may constitute a wedge-shaped member to firmly fit the hook members 185. The hood members 185 are bolted, through a base plate 190 to the pier bracket 105. Braces 195 support the hook members 185.

During operation, this alternative embodiment performs in substantially the same manner as the first embodiment. However, the transition rods 150 are not fastened through telescoping collar arms, but instead are merely attached to the hook members 185 on opposite sides of the pier bracket 105.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for exerting an auxiliary anchoring force upon an underpinning drive assembly, during a pier sinking operation in which said underpinning drive assembly drives piers into the ground to support a structure, said auxiliary anchoring force supplementing a principal anchoring force provided by a dead weight of said structure along a first path, said apparatus comprising:

a pier bracket for supporting said underpinning drive assembly while said piers are being sunk into the ground along said first path, said pier bracket securing said underpinning drive assembly to said structure to use said dead weight as said principal anchoring force along said first path;

anchoring means for being sunk into the ground, said anchoring means providing said auxiliary anchoring force to supplement said dead weight of said structure by providing a predetermined amount of resistance against movement along said first path; and securing means for releasably fastening said anchoring means to said pier bracket, said securing means including means for providing relative motion between said anchoring means and said pier bracket along a second path, while preventing relative motion therebetween along said first path.

2. An apparatus according to claim 1, wherein said anchoring means includes a helical screw-type anchor which is drilled into the ground to a depth corresponding to said predetermined amount of resistance.

3. An apparatus according to claim 2, wherein said screw-type anchor includes an upper end projecting out of the ground, and a transition rod fastened between said upper end and said securing means.

4. An apparatus according to claim 1, wherein said securing means is pivotally mounted, at a pivot joint, on said pier bracket and rotatable in an arcuate path about said pivot joint to fasten said anchoring means to said pier bracket.

5. An apparatus according to claim 1, wherein said securing means includes an arm that is slidable along a linear path toward and away from said pier bracket.

6. An apparatus according to claim 1, wherein said securing means includes a base with rectangular flat plates secured to said pier bracket and with flanges for pivotally supporting an outrigger body that is fastened to said securing means.

7. An apparatus according to claim 6, wherein said outrigger body includes a pivot joint rotatably secured to said flange and a square collar arm secured to said pivot joint, said collar arm being hollow and slidably receiving a telescoping arm that is secured to said anchoring means.

8. An apparatus according to claim 1, wherein said anchoring means includes a helical anchor and said securing means includes at least one hook member mounted on said pier bracket to securely fasten the pier bracket to said helical anchor.

9. A method for exerting an auxiliary anchoring force upon an underpinning drive assembly, during a pier sinking operation in which said underpinning drive assembly drives piers into the ground to support a structure, said auxiliary anchoring force supplementing a principal anchoring force provided by a dead weight of said structure along a first path, said method comprising the steps of:

attaching said underpinning drive assembly to said foundation to use said dead weight as said principal anchoring force along the first path;

installing, into the ground proximate the underpinning drive assembly, at least one anchor to a depth, at which the anchor exhibits a predetermined pullout resistance along the first path; and securing said anchor to said underpinning drive assembly to provide said auxiliary anchoring force along the first path supplementing said principal anchoring force provided by a dead weight of said structure, and to allow relative movement between the underpinning drive assembly and anchor along a second path differing from the first path.

10. A method according to claim 9, further comprising the step of removing said anchor from the ground after said underpinnings are sunk to a desired depth.

11. A method according to claim 9, further comprising the step bracing said underpinning drive assembly against horizontal movement.

12. A method according to claim 9, further comprising the step of, prior to said attaching step, excavating an area of earth immediately adjacent a foundation of said structure to expose a footer of the foundation, said underpinning drive assembly being secured to the foundation within said excavation area.

13. A method according to claim 9, wherein said securing step includes the steps of fastened said underpinning drive assembly to said anchor in one of a pivotal and slidable connection, to allow relative motion therebetween along one of linear and arcuate paths to align said underpinning drive assembly with said anchor; and fastening said underpinning drive assembly to said anchor.

14. A method according to claim 9, further comprising the step of aligning said anchor in a substantially vertical position proximate said underpinning drive assembly, but not under said foundation.

15. A method according to claim 9, wherein said underpinnings are sunk, during said sinking step, along a longitudinal axis which projections in a substantially vertical direction position and wherein said anchor is aligned and installed at an acute angle with respect to said longitudinal axis, an upper end of said anchor being positioned immediately adjacent and secured to said underpinning drive assembly.

16. An apparatus for pressing a pier into the ground along a first direction to support a structure, said pier having smooth sides to reduce wall friction while being pressed into the ground, said apparatus comprising:

a drive cylinder for pressing each pier along a longitudinal axis of the pier parallel to said first direction without turning the pier;

a pier bracket for supporting said drive cylinder while pressing said pier into the ground, said pier bracket securing said drive cylinder to the structure to use a dead weight of the structure as a principal anchoring force along a direction parallel to said longitudinal axis of the pier;

anchoring means, sunk into the ground, for providing an auxiliary anchoring force along a direction parallel to said longitudinal axis of the pier to supplement said dead weight of said structure by providing a predetermined amount of resistance against movement of the pier bracket along said longitudinal axis; and securing means for releasably fastening said anchoring means to said pier bracket.

17. An apparatus according to claim 16, wherein said securing means includes at least one outrigger attached to said pier bracket and said anchoring means, said securing means preventing vertical motion therebetween, while allowing rotary motion therebetween.

18. An apparatus according to claim 16, wherein said securing means allows one of pivotal and horizontal motion between said anchor means and said pier bracket, while preventing vertical motion therebetween.

19. A method for pressing a smooth underpinning into the ground along a first direction to support a structure, said method comprising the steps of:

attaching a drive cylinder to a structure to use a dead weight of the structure as a principal anchoring force along a longitudinal axis of the pier parallel to said first direction;

installing, into the ground proximate the drive cylinder, at least one anchor to a depth, at which the anchor exhibits a predetermined pullout resistance along a direction parallel to said longitudinal axis of the pier;

securing said anchor to said drive cylinder in order for said anchor to provide an auxiliary anchoring force, along said direction parallel to the longitudinal axis of the pier, supplementing said principal anchoring force provided by the dead weight of the structure and parallel thereto; and pressing an underpinning along said longitudinal axis with said drive cylinder, without turning said underpinning, said underpinning being used to support said structure.

20. An apparatus for exerting an auxiliary anchoring force upon an underpinning drive assembly, during a pier sinking operation in which said underpinning drive assembly drives piers into the ground to support a structure, said auxiliary anchoring force supplementing a principal anchoring force provided by a dead weight of said structure, said apparatus comprising:

a pier bracket for supporting said underpinning drive assembly while said piers are being sunk into the ground, said pier bracket securing said underpinning drive assembly to said structure to use said dead weight as said principal anchoring force;

anchoring means for being sunk into the ground, said anchoring means providing said auxiliary anchoring force to supplement said dead weight of said structure by providing a predetermined amount of resistance against upward movement; and securing means for releasably fastening said anchoring means to said pier bracket, said securing means is pivotally mounted, at a pivot joint, on said pier bracket and rotatable in an arcuate path about said pivot joint to fasten said anchoring means to said pier bracket.

21. An apparatus according to claim 16, wherein said first axis aligned along a substantially vertical axis.

22. A method according to claim 19, wherein said first axis is aligned along a substantially vertical axis.

* * * * *